US006684592B2

(12) United States Patent
Martin

(10) Patent No.: US 6,684,592 B2
(45) Date of Patent: Feb. 3, 2004

(54) INTERLOCKING FLOOR PANELS

(76) Inventor: Ron Martin, 3520 Candlewood Dr., Bakersfield, CA (US) 93306

( * ) Notice: Subject to any disclaimer, the term of this patent is extended or adjusted under 35 U.S.C. 154(b) by 0 days.

(21) Appl. No.: 10/217,960

(22) Filed: Aug. 12, 2002

(65) Prior Publication Data

US 2003/0041542 A1 Mar. 6, 2003

Related U.S. Application Data

(60) Provisional application No. 60/312,294, filed on Aug. 13, 2001.

(51) Int. Cl.[7] ..... E04B 2/08; E04B 2/18; E04B 2/32; E04B 2/46

(52) U.S. Cl. ..... 52/591.5; 52/591.1; 52/591.3; 52/591.4; 52/592.2; 52/592.1; 403/341; 403/331

(58) Field of Search ..... 52/591.4, 591.3, 52/174, 177, 591.1, 591.5, 390, 592.1, 263; 403/292, 293, 294, 286, 341, 331

(56) References Cited

U.S. PATENT DOCUMENTS

| | | | | | |
|---|---|---|---|---|---|
| 320,697 | A | * | 6/1885 | Rider | 52/591.4 |
| 440,008 | A | * | 11/1890 | Caldwell | 52/591.4 |
| 1,670,678 | A | * | 5/1928 | Cower | 404/32 |
| 2,490,577 | A | * | 12/1949 | Brown | 52/591.1 |
| 4,388,788 | A | * | 6/1983 | Bosco | 52/390 |
| 4,416,100 | A | * | 11/1983 | Troendle, Sr. | 52/390 |
| 4,807,412 | A | * | 2/1989 | Frederiksen | 52/177 |
| 5,634,309 | A | * | 6/1997 | Polen | 52/392 |
| 5,899,038 | A | * | 5/1999 | Stroppiana | 399/228 |
| 5,918,437 | A | * | 7/1999 | Dobija | 52/506.01 |
| 6,098,362 | A | * | 8/2000 | Marriott et al. | 52/302.3 |
| 6,189,289 | B1 | * | 2/2001 | Quaglia et al. | 52/764 |
| 6,194,051 | B1 | * | 2/2001 | Gagas et al. | 428/99 |
| 6,253,513 | B1 | * | 7/2001 | Saida | 52/392 |
| 6,418,697 | B1 | * | 7/2002 | Da Molin | 52/792.11 |
| 6,446,413 | B1 | * | 9/2002 | Gruber | 52/747.11 |
| 6,505,452 | B1 | * | 1/2003 | Hannig et al. | 52/582.1 |
| 2002/0112433 | A1 | * | 8/2002 | Pervan | |

* cited by examiner

*Primary Examiner*—Carl D. Friedman
*Assistant Examiner*—Nahid Amiri
(74) *Attorney, Agent, or Firm*—James M. Duncan

(57) ABSTRACT

The disclosed invention is a portable floor comprised of interlocking floor panels which may be used for dancing, theatrical productions, musical performances, trade shows, and other settings where it is desirable to have a firm wooden floor surface. The disclosed invention enables a single person to install or disassemble the portable floor. It eliminates the need for storing any additional hardware to connect the panels to one another. No special tools are required to assemble or disassemble a floor. The floor is easy to assemble. Once the portable floor is assembled each panel is locked at two different places, thus firmly connecting the floor together. Panels may be added as desired to increase the size of the floor.

7 Claims, 6 Drawing Sheets

INTERLOCKING FLOOR PANELS

CROSS-REFERENCE TO RELATED APPLICATION

U.S. Provisional Application No. 60/312,294 was filed for this invention on Aug. 13, 2001 for which the inventor claims domestic priority.

BACKGROUND OF THE INVENTION

The present invention generally relates to portable floors and more specifically to a system of interconnecting floor panels which connect together to form the floor surface. This portable surface may be used for a variety of different purposes, such as a portable stage, dancing, trade show displays and exhibits.

It is known that portable floors are often required for various purposes. For example, floors made specifically for dancing provide a great deal of recreation, exercise and personal enjoyment to their users. A preferred dancing surface is a hard, smooth, wood-like surface having a certain amount of spring. Although other surfaces may be danced upon, the action, feel and appearance of a surface made specifically for dancing is appreciated by both professional and novice dancer alike. However, a permanently-installed dance floor is expensive to install and can easily be damaged if used for other activities other than dancing. These problems were solved with the development of the portable dance floor.

Portable dance floors come in readily transportable sections which fit together to meet the needs of a particular function or activity. The floors of a hotel banquet room, recreation center, church hall, convention center or home living room may quickly be transformed to a dance floor through the installation of a portable dance floor. However, despite their convenience, portable dance floors present a unique set of challenges. A portable dance floor should install quickly and easily, provide a secure and smooth dancing surface, and be able to withstand the forces and wear and tear of people walking and dancing upon it.

Portable floors may also be used for setting up stages for theatrical or musical performances. A portable floor may also be used in a convention or trade show setting where a hard surface is desired for setting up a display or promotion. The requirements for these types of floor are frequently the same as for the portable dance floor described above.

Because portable floors typically come in sections, it is necessary to interconnect the various sections to make up the whole floor. Particularly in the case of dancing and theatrical productions, the sections of the portable floor should connect so there are no open seams, holes, or raised surfaces or objects which a dancer or performer might trip or stumble upon. In the case of dance floors, as a floor is danced upon, especially by professional dancers, a variety of forces are exerted upon the floor. Among these forces are lateral forces which will act to separate the individual sections of the floor unless the sections are adequately anchored together. However, the system employed to secure the sections together should be designed so that it not only prevents the sections from separating, but also allows for easy and rapid assembly and disassembly.

It is also desirable to have a connecting system which utilizes a minimum amount of hardware. Many users, including hotels, churches, etc., purchase portable floors for periodic use and enjoyment. However, the enjoyment and practicality of the device can be easily frustrated if hardware necessary to hold the floor together is misplaced, causing either delays in assembling the floor, or tempting the user to assemble the dance floor without all of the connecting hardware, which is not safe and can greatly reduce enjoyment of the floor.

Earlier forms of portable dance floors employed tongue and groove construction, where the tongue of one section fit within the groove of an abutting section, and the connection secured with a removable screw or bolt set through the tongue and groove. However, this type of connection makes assembly a slow a tedious process because each screw or bolt must be inserted and made up. Likewise, disassembly is slow and tedious. In addition, a screw or bolt head which is not entirely flush with the surface of the dance floor creates a potential hazard for the user. Finally, when the floor is not in use, the loose fasteners must be stored such that they are readily located for the next use.

In an effort to solve the above problems with bolted tongue and groove connections, U.S. Pat. No. 5,465,546 discloses a system for connecting a portable dance floor which does not use screws or bolts to join adjacent sections of the floor. The system disclosed in Pat. No. '546 uses a main connector plate which is placed at the junction of four adjoining sections of the dance floor. Also disclosed in the '546 patent is a tool used to disassemble the dance floor. While the system of the '546 patent is superior to the bolted tongue and groove connections, it still has disadvantages. First, setting up and tearing down the floor can be difficult. As disclosed in the '546 patent, at least two people are required to disassemble the floor, and a special tool is required. Second, the user of a portable dance floor with the disclosed system must continue to store a relatively small piece of hardware, i.e., the connector plates, which can easily be mislocated from the larger sections of the dance floor.

U.S. Pat. No. 6,189,283 discloses a portable dance floor in which adjacent panels are connected together with tongue and groove connections, where the tongue section is angled for locking into the groove. Assembly of the connecting sections requires lifting the panel to be joined and can be complicated by the different sizes of the panels. Disassembly of the floor can be difficult as well, as lateral forces applied to the surface of the floor can wedge the tongue elements tightly within the groove element, making it difficult to dislodge the tongue element. Moreover, each panel of this system has tongue elements protruding from the side of each panel, which can be broken off or otherwise damaged. Thus, while the connection system disclosed in the '283 patent eliminates the problem of requiring additional hardware and/or tools for disassembly, it presents other potential problems.

SUMMARY OF THE INVENTION

The present invention is directed to a connection system for a portable floor which solves the problems identified above.

One embodiment of the disclosed portable floor comprises a plurality of rectangular panels. Each panel has a top surface which is used as the dancing or activity surface, and a bottom surface, which rests upon the ground, floor, or other support. The four sides of the rectangle comprise a first side having a first male edge, a second side adjacent to the first side, the second side having a second male edge, a third side having a first groove oriented along the long axis of the third side, and a fourth side, adjacent to the third side, the fourth side having a second groove oriented along the long axis of the fourth side.

Each male edge has two ends, comprising a locking end and a free end. The first groove is adapted for receiving the first male edge of a first adjacent panel, the first groove having an engagement member within the first groove for engaging the locking end of the first male edge. Likewise, the second groove is adapted for receiving the second male edge of a second adjacent panel, the second groove having an engagement member within the second groove for engaging the locking end of the second male edge.

The locking end of each male edge may comprise locking means such as a splined or beveled edge or a J-hook. These structures may be fashioned directly from the material comprising the end of the male edge, or the locking end may be attached to the male edge. The engagement member of each groove may comprise a female receiver adapted to receive the male spline or beveled edge. Alternatively, the engagement member may comprise a post generally oriented vertically at a right angle to the groove, the post configured to receive the J-hook of the male edge of an adjacent panel.

Once the locking end of the male edge of one panel engages the engagement member within the groove of an adjacent panel, the remainder of the male edge is fitted into the groove so that the entire length of the male edge is inserted into the groove. The two panels are further secured together with secondary locking means, which may comprise either a clip attached to one of the panels, or transition pieces which may be installed around the entire perimeter of the portable floor. Transition pieces are known in the art as beveled pieces going from the surface of the underlying floor to the level of the portable dance floor. The transition pieces lock onto the outward facing edges of the exterior panels, thus locking the entire floor. Disassembly of the floor is achieved by simply reversing the assembly steps.

The disclosed locking system enables a single person to install or disassemble a portable floor. It eliminates the need for storing any additional hardware to connect the panels to one another. No special tools are required to assemble or disassemble a floor. The floor is easy to assemble. Once the portable floor is assembled each panel is locked at two different places, thus firmly connecting the floor together. Panels may be added as desired to increase the size of the floor.

DETAILED DESCRIPTION OF THE EMBODIMENTS

Figure 1:
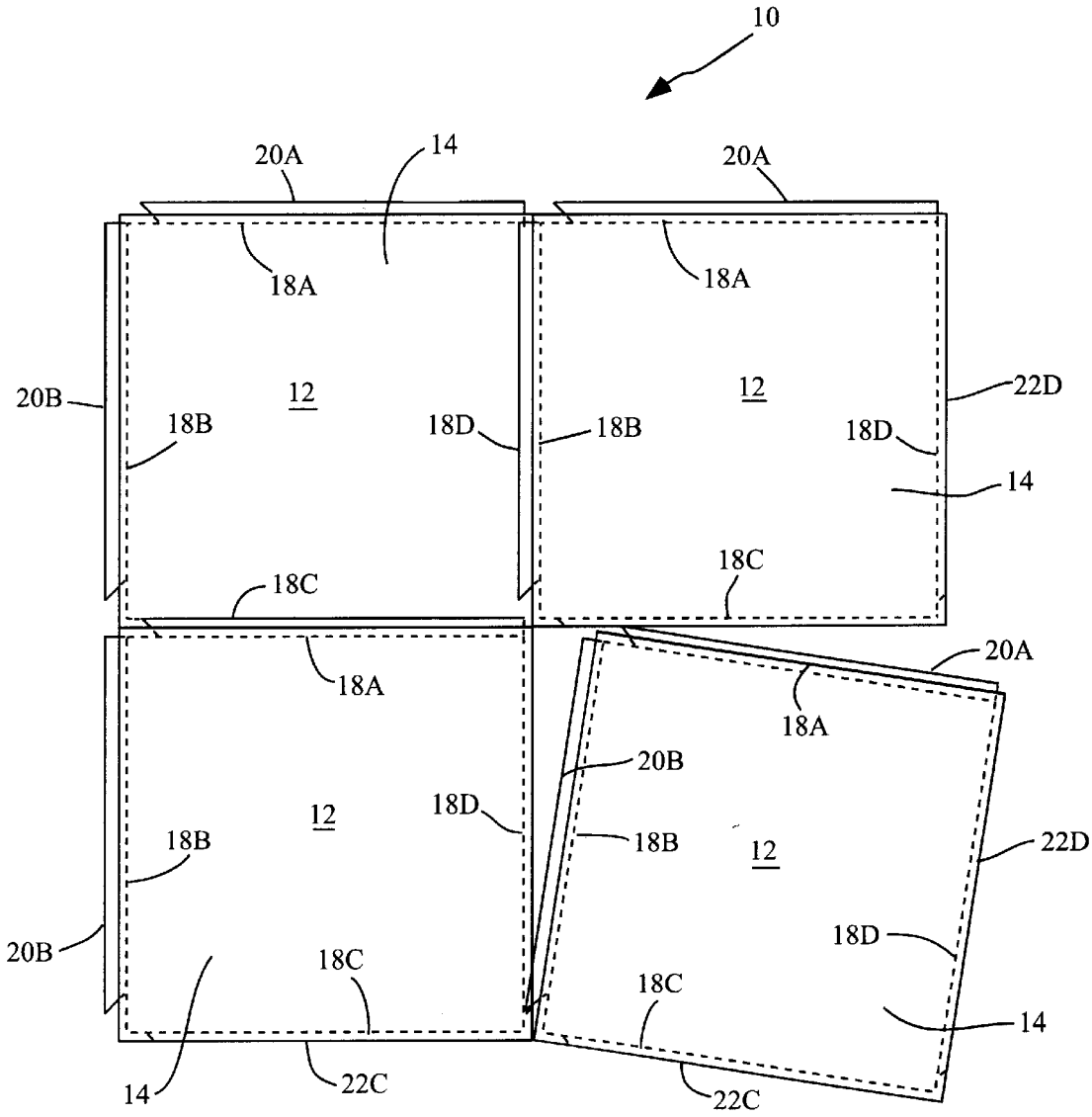
FIG. 1 is top view of a four panel section of the disclosed portable floor, using a spline type of locking end.

Referring now to the drawings, FIG. 1 is plan view of the disclosed invention, showing a top view of one embodiment 10 of the disclosed portable floor. For purposes of illustration only, FIG. 1 shows a portable floor made up of four separate panels 12, although the portable floor might be made up of any number of panels 12 so long as the resulting floor forms a rectangle or square.

Each panel 12 has a top surface 14, a bottom surface 16 (not shown) and four sides 18A through 18D. The four sides comprise a first side 18A having a first male edge 20A, a second side 18B adjacent to the first side 18A, the second side 18B having a second male edge 20B, a third side 18C having a first groove 22C oriented along the long axis of the third side, and a fourth side 18D, adjacent to the third side 18C, the fourth side 18D having a second groove 22D oriented along the long axis of the fourth side 18D.

Figure 2:
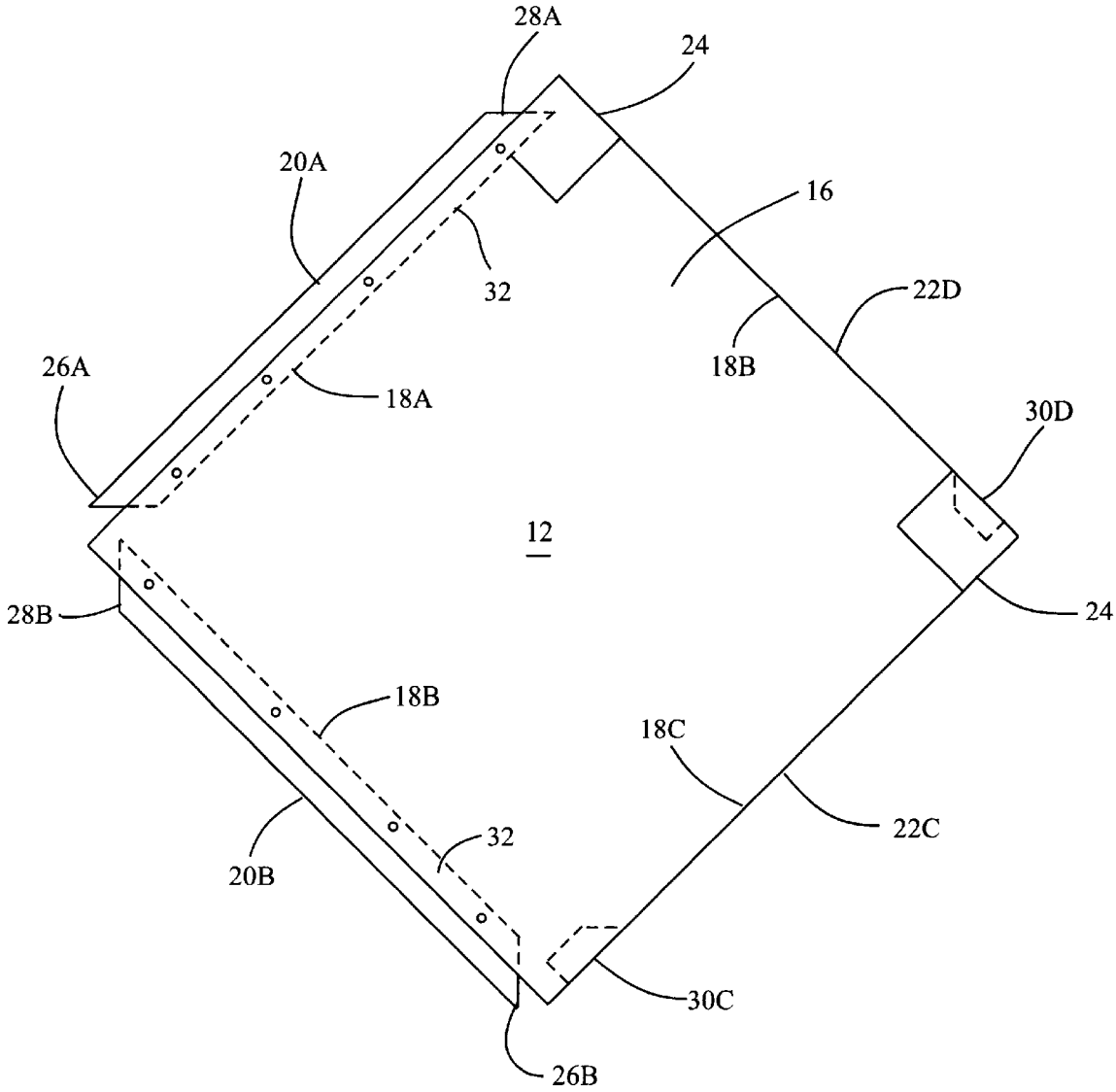
FIG. 2 shows a bottom view of a single panel of the disclosed portable floor.
Figure 3:
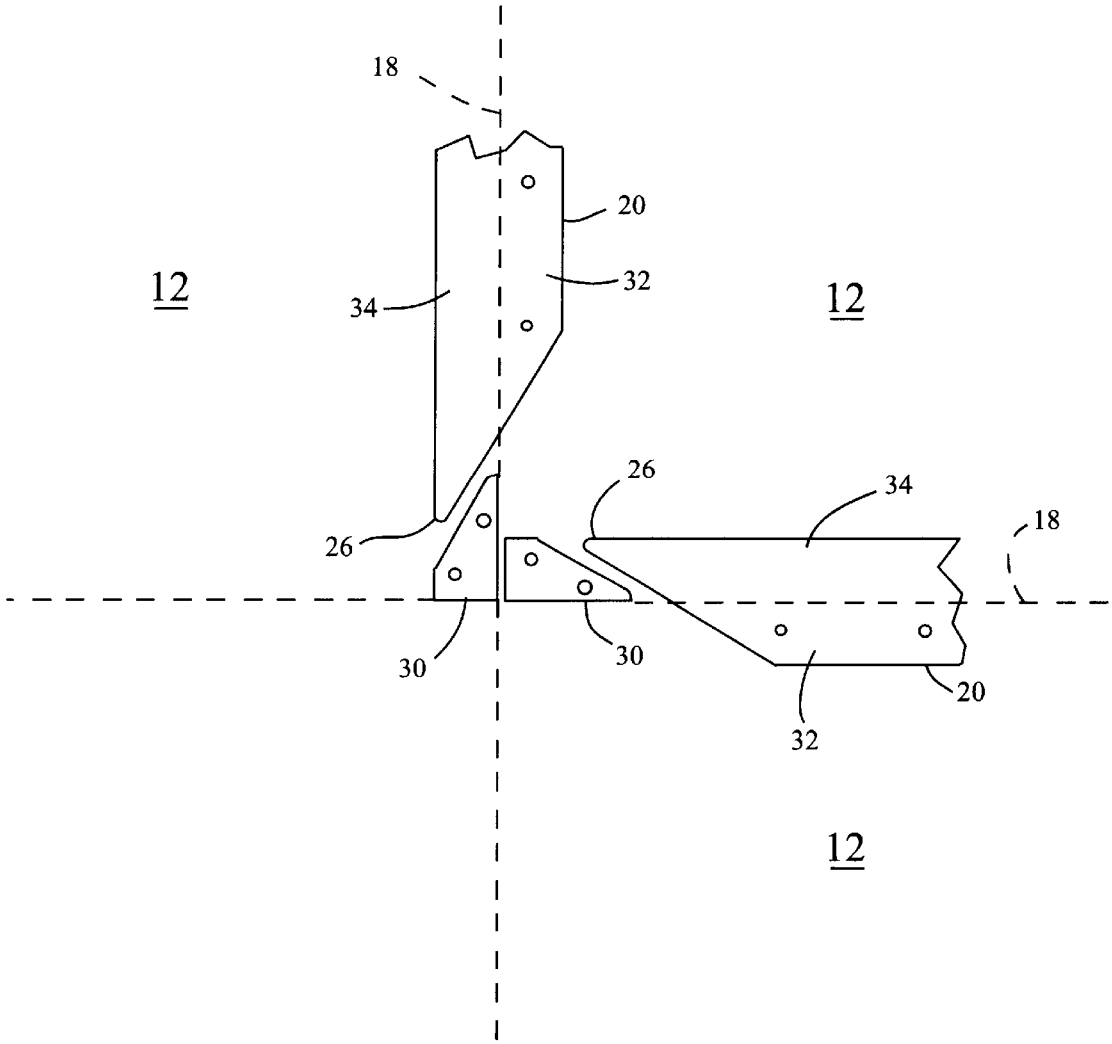
FIG. 3 is a schematic view of the spline type of locking end.

FIG. 2 shows the bottom surface 16 of an individual panel 12. The panel itself may be constructed from tongue and groove planking, using appropriate dance surfaces such as maple, ash or birch. Either solid planks or laminated planks may be used. A backing material may be applied to the bottom surface 16 of each panel 12 to provide a surface which does not slip on the surface underlying the portable floor. A suitable backing material is a sheet of luan mahogany of approximately one eighth inch in thickness, which may be glued, stapled or otherwise attached to the bottom surface 16. Alternatively, rubber non-skid pads 24 may be attached to the bottom surface 16 of the panel 12 to inhibit sliding of the panel As shown in FIG. 2, the first male edge 20A has two ends, comprising a locking end 26A and a free end 28A. The free end 28A may be tapered or angled. Likewise, second male edge 20B has two ends, comprising a locking end 26B and a free end 28B. One acceptable locking end 26 is illustrated in FIG. 3, which discloses a spline as the locking end 26. It is to be appreciated that while locking ends 26A and 26B could use a different mechanism, such as the alternative embodiment shown in FIG. 4 and discussed below, it is preferred, but not necessary, to use the same mechanism for locking ends 26A and 26B for all of the panels used within the same portable floor.

First groove 22C is adapted to receive the first male edge 20A of a first adjacent panel which may be attached to the panel 12 shown in FIG. 2. First groove 22C has an engagement member 30C within the first groove for engaging the locking end of a first adjacent panel. The locking end of the first adjacent panel will be the same as locking end 26A of panel 12 shown in FIG. 2. Likewise, second groove 22D is adapted to receive second male edge 20B of a second adjacent panel which may be attached to panel 12. Second groove 22D has an engagement member 30D within the second groove for engaging the locking end of a second adjacent panel. The locking end of the second adjacent panel will be the same as locking end 26B of panel 12 shown in FIG. 2.

FIG. 3 shows detail of one embodiment of locking end 26 and corresponding engagement member 30. In this embodiment, locking end 26 comprises a spline and engagement member 30 comprises a slot adapted to receive the spline. The spline may be fashioned directly from the material comprising male edge 20, which is preferably steel, aluminum or other appropriate metallic material. Alternatively, the spline may be fashioned from different material and attached to the end of male edge 20. Male edge 20 may be attached to panel 12 in a variety of ways. Side 18 of panel 12 may be grooved such that the rear section 32 of male edge 20 is inserted into the groove and fastened with rivets, screws, or other appropriate fastening means.

Alternatively, the rear section 32 might be fastened to the bottom surface 16, in which case the bottom surface would be routed so that rear section 32 is flush with the bottom surface. In this embodiment, the forward section 34 of male edge 20 must be adapted such that it is capable of engaging groove 22, which should be located in the approximate middle of side 18 (i.e., the middle of the thickness of the panel).

Engagement member 30 is located within groove 22, such that when two panels are desired to be attached together, locking end 26 is inserted into groove 22 until locking end 26 engages the engagement member 30, at which point the remainder of male edge 20 is inserted into groove 22. One embodiment of engagement member 30 is shown in detail in FIG. 3, in which the engagement member 30 comprises a slot adapted to receive the spline type of locking end 26.

Figure 4:
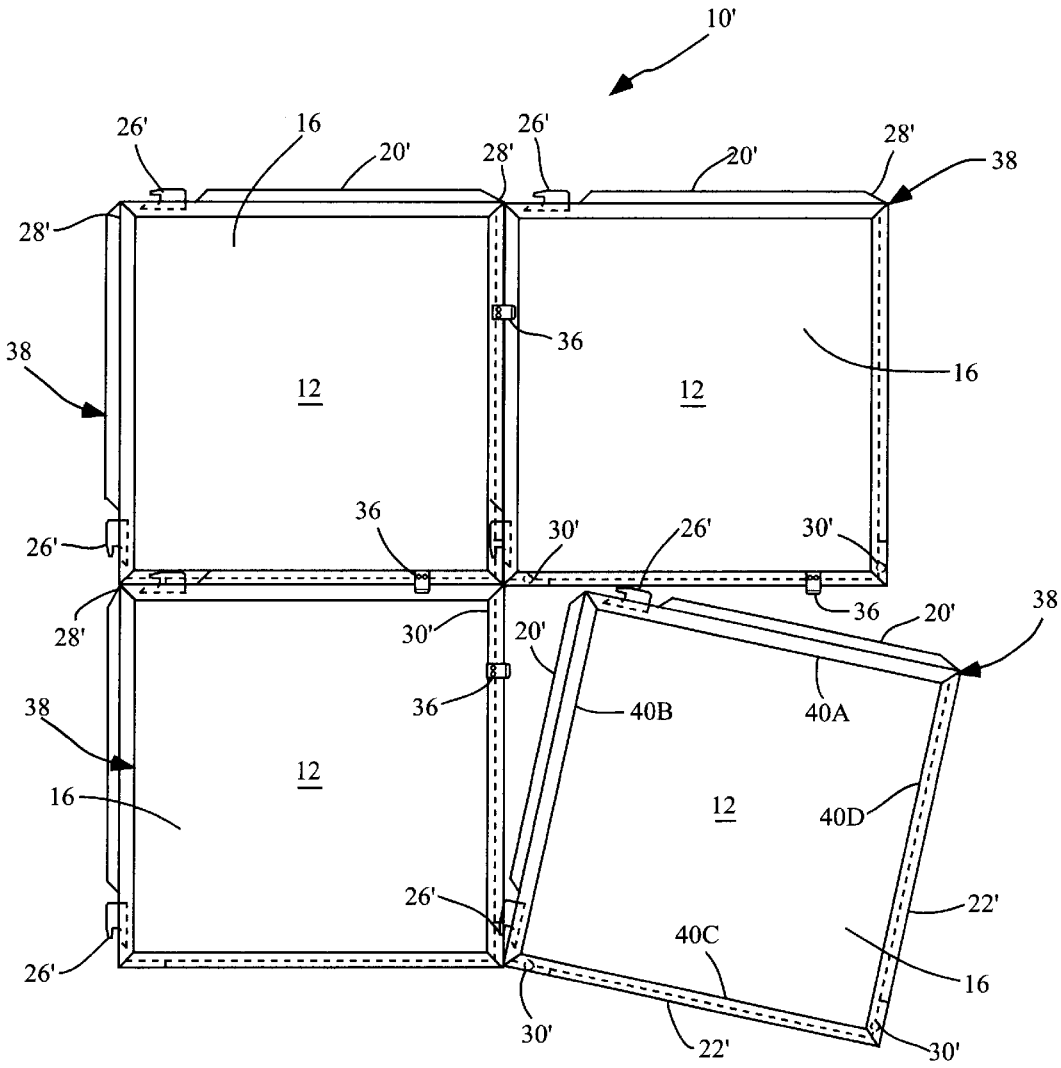
FIG. 4 shows a bottom view of a four panel section of the disclosed portable floor, where the panels are framed a J-hook type of locking end is used.

Different embodiments of the locking end and engagement member are shown in FIG. 4. Locking end 26' is a J-hook which may either be fashioned directly from the material comprising male edge 20', which is preferably steel, aluminum or other appropriate metallic material. Alternatively, the J-hook may be fashioned from different material and attached to the end of male edge 20'. Alternatively, as indicated in FIG. 4, a J-hook may be attached to a side 18 of the panel, so the J-hook is a separate piece from the male edge 20'. The J-hook engages engagement member 30'. When a J-hook is used, engagement member 30' comprises a post generally oriented at a right angle to groove 22'.

Secondary locking means are used to secure the panels together. One type of secondary locking means is locking clip 36, which may be attached directly to the bottom surface 16 of panel 12. The locking clip 36 may be a friction type lock which engages a lip or protrusion of the adjacent panel, acting to hold the free end 28 of the male edge 20 within groove 22.

An alternative embodiment 10' of the portable floor is also depicted in FIG. 4. In this embodiment, the peripheral edge surface defined by the four sides 18 of a panel 12 may be bound and supported within a frame 38, the frame comprising a first member 40A, a second member 40B, a third member 40C and a fourth member 40D. The outside surface of members 40A and 40B are configured to have a male edge 20' extending outwardly from the member. Members 40C and 40D are each configured to have a groove 22' extending inwardly into the member, the long axis of each groove 22' coinciding with the respective long axis of member 40C and 40D. As with the embodiment disclosed above, each male edge 20' has a a locking end 26' and a free end 28'. Each groove 22' has engagement member 30' for locking end 26' to engage. As depicted in FIG. 4, locking means 26' may comprise a J-hook located at the end of male edge 20', which engages engagement member 30'. When a J-hook is used, engagement member 30' comprises a post generally oriented at a right angle to groove 22'. However, the locking end 26 and engagement member 30 depicted in FIG. 3 may also be used with the framed panel embodiment.

Figure 5:
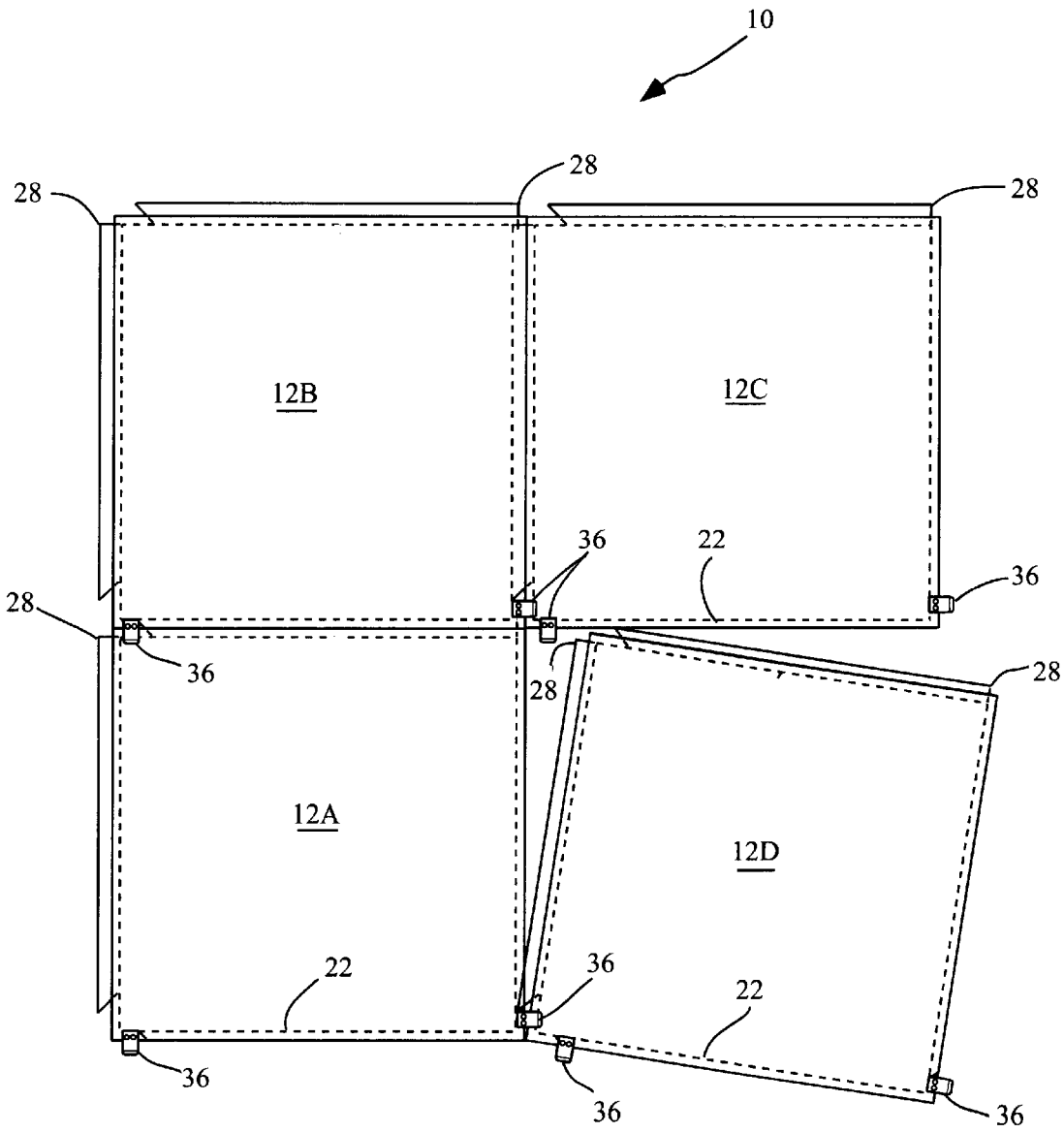
FIG. 5 shows a bottom view of a four panel section of the disclosed portable floor, using a spline type of locking end.

It is to be appreciated, from a review of FIG. 5 that the addition of the fourth panel 12D interlocks the four panels 12A, 12B, 12C and 12D together, so that each panel 12 is locked onto two adjacent panels. Additional panels may be added as desired in a similar fashion until the desired dance floor size is achieved. When the desired size of floor is achieved by connecting a plurality of panels, each panel should be secured to two of the adjacent panels, thereby interlocking the panels. The top surfaces of the panels form a flush surface without seams, connectors, or edges extending above the surface of the floor. Transition pieces having matching tongue and groove components may be attached at the periphery of the floor, with a single transition piece connecting the outside edges of two panels, thereby locking the entire floor into place. For example, with respect to FIG. 5, once panel 12D is locked into place, a transition piece is installed which locks onto the outside edges of panels 12C and 12D. This transition piece prevents panel 12D from rotating or shifting in a clockwise direction.

Figure 6:
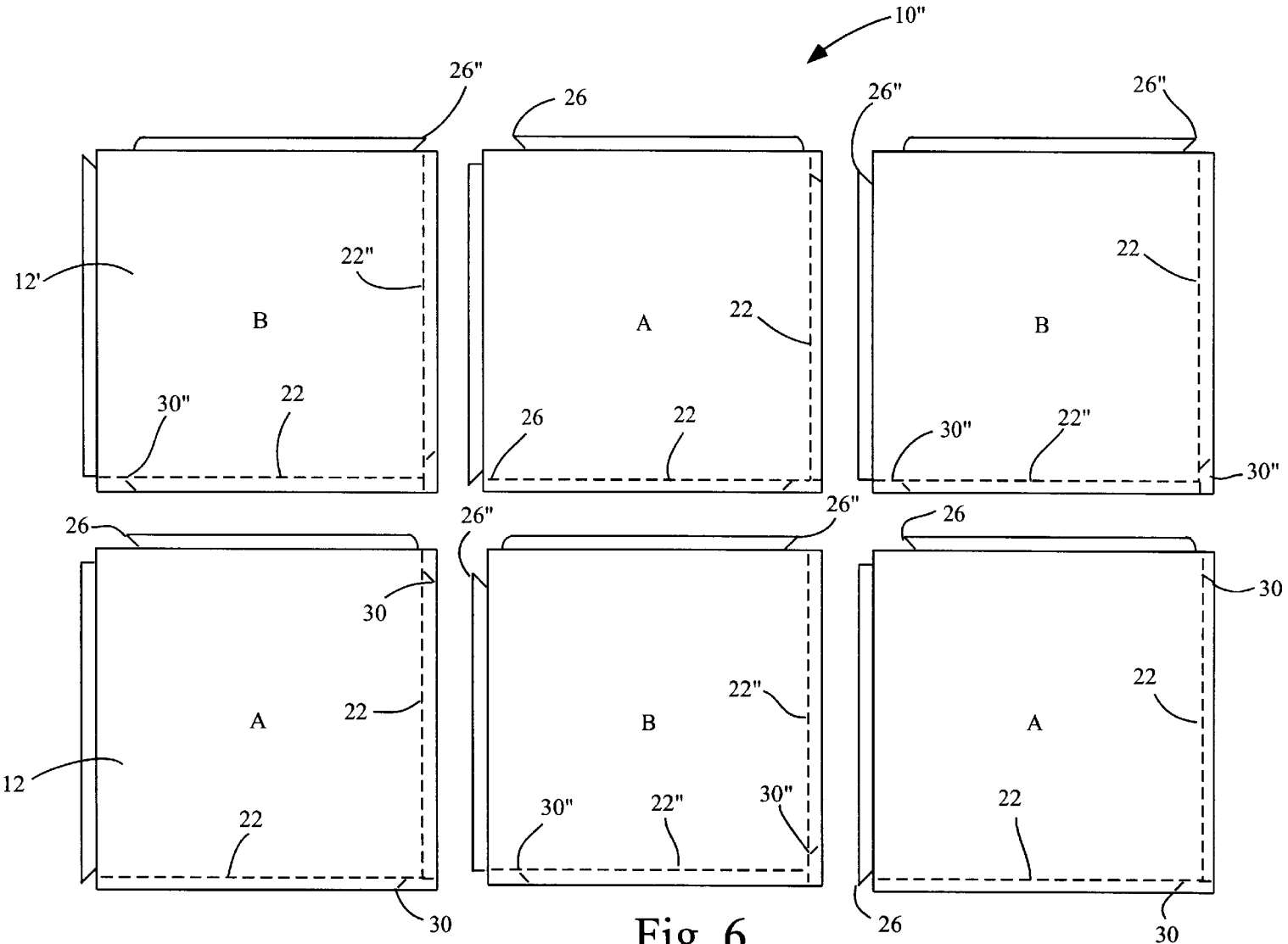
FIG. 6 is a top view of an alternative embodiment of six panels of the disclosed portable floor, showing the placement of an "A" panel and a "B" panel.

FIG. 6 discloses another embodiment 10" of the portable dance floor. In this embodiment, two different panels are utilized, an "A" panel 12 and a "B" panel 12'. The "A" panel 12 is the same as the panels disclosed above. The only difference with the "B" panel 12' is that the orientation of locking end " and engagement member 30" are changed so that the locking end 26" is on the other side of male edge 20". Engagement member 30" is correspondingly shifted to the other side of groove 22". With this embodiment, an "A" panel 12 will only mate with a "B" panel 12' and vice-versa. FIG. 6 shows a floor of six panels would be configured. Additional panels would be added accordingly. It is to be appreciated that either the spline or the J-hook may be used for locking end 26", and engagement member 30" may be either the slot adapted to engage the spline, or the post adapted to engage the J-hook.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed.

What is claimed is:

1. A portable floor comprising:

(a) a plurality of rectangular panels adjacent to one another, each panel having a top surface, a bottom surface and four sides, the four sides collectively defining a peripheral edge surface;

(b) a frame bounding the peripheral edge surface, the frame comprising a first member having a first male edge, a second member adjacent to the first member, the second member having a second male edge, a third member having a first groove oriented along the long axis of the third member, and a fourth member, adjacent to the third member, the fourth member having a second groove oriented along the long axis of the fourth member;

(c) the first male edge and second male edge each having two ends, comprising a locking end and a free end;

(d) the first groove adapted for receiving the first male edge of a first adjacent panel, the first groove having an engagement member for engaging the locking end of the first adjacent panel;

(f) the second groove adapted for receiving the second male edge of a second adjacent panel, the second groove having an engagement member for engaging the locking end of the second adjacent panel; and (g) secondary locking means for locking adjacent panels together.

2. The portable floor of claim 1 wherein the first male edge has the same dimensions as the second male edge and the first groove has the same dimensions as the second groove.

3. The portable floor of claim 1 wherein the locking end comprises a J-hook and the engagement member comprises a post generally oriented at a right angle to the groove.

4. The portable floor of claim 1 wherein the secondary locking means comprises locking clips connecting adjacent panels.

5. A portable floor comprising (a) at least four uniformly sized panels, each panel having a top surface, a bottom surface and four sides, the four sides defining a peripheral edge surface;

(b) each panel further comprising:

(i) a frame bounding the peripheral edge surface, the frame comprising a first side having a male edge extending outwardly therefrom, a second side adjacent to the first side, the second side having a male edge extending outwardly therefrom, a third side having a first groove oriented along the long axis of the third side, and a fourth side, adjacent to the third side, the fourth side having a second groove oriented along the long axis of the fourth side;

(ii) the male edge having two ends comprising a locking end and a free end;

(iii) the first groove adapted for receiving the first male edge of a first adjacent panel, the first groove having an engagement member for engaging the locking end of the first adjacent panel;

(iv) the second groove adapted for receiving the second male edge of a second adjacent panel, the second groove having an engagement member for engaging the locking end of the second adjacent panel; and (c) secondary locking means for locking adjacent panels together.

6. The portable floor of claim 5 wherein the locking end comprises a J-hook and the engagement member comprises a post generally oriented at a right angle to the groove.

7. The portable floor of claim 5 wherein the secondary locking means comprises locking clips connecting adjacent panels.

* * * * *